US010213833B2

(12) United States Patent
Heck

(10) Patent No.: US 10,213,833 B2
(45) Date of Patent: Feb. 26, 2019

(54) METHOD FOR FORMING TOOLING AND FABRICATING PARTS THEREFROM

(71) Applicant: The Boeing Company, Chicago, IL (US)

(72) Inventor: David P. Heck, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 621 days.

(21) Appl. No.: 14/820,545

(22) Filed: Aug. 6, 2015

(65) Prior Publication Data

US 2017/0036297 A1 Feb. 9, 2017

(51) Int. Cl.
*B22F 3/14* (2006.01)
*B22F 3/12* (2006.01)

(52) U.S. Cl.
CPC ..... *B22F 3/14* (2013.01); *B22F 3/1283* (2013.01)

(58) Field of Classification Search
CPC .. B29C 43/006; B22F 3/00; B22F 3/14; B22F 3/1283
USPC ..... 264/219
See application file for complete search history.

(56) References Cited

U.S. PATENT DOCUMENTS 4,673,549 A 6/1987 Ecer
5,061,439 A * 10/1991 Nyrhila ..... B22F 1/0003 228/173.6
2008/0203640 A1 8/2008 Halford
2009/0056517 A1 3/2009 Halford

FOREIGN PATENT DOCUMENTS

WO 9310935 6/1993

* cited by examiner

*Primary Examiner* — Weiping Zhu
(74) *Attorney, Agent, or Firm* — Kunzler, PC

(57) ABSTRACT

A method of forming tooling for fabricating a part made from a metal powder is described herein. The method includes forming a first sheet and second sheet. The first sheet includes a first protrusion defining a first cavity and a first flange extending about the first protrusion. The second sheet includes a second flange. Additionally, the method includes arranging the first sheet and the second sheet to abut together the first flange of the first sheet and the second flange of the second sheet and to define an enclosure. The enclosure includes a void defined between the first cavity of the first sheet and the second sheet. The void has a shape of the part. The method further includes welding together the first flange of the first sheet and the second flange of the second sheet along a portion of the first flange spaced away from the first protrusion.

15 Claims, 8 Drawing Sheets

METHOD FOR FORMING TOOLING AND FABRICATING PARTS THEREFROM

FIELD

This disclosure relates generally to the fabrication of parts into desired shapes, and more particularly to forming tooling and fabricating parts made from metal powder into desired shapes using such tooling.

BACKGROUND

The fabrication of parts using powder metallurgy offers advantages over traditional metallurgy. For example, parts made from powder metallurgy often are fabricated at lower costs, closer to net shape, and with improved metal alloys compared to traditional metallurgy.

Conventional powder metallurgy techniques include encapsulating and consolidating metal powders within an enclosure. The enclosure is formed by welding together two or more metal sheets. Conventional techniques for welding sheets together to form an enclosure include placing welds in the portion of the sheets defining the space used to shape the part. Such welds tend to impart residual stress on the sheets, which can cause the sheets to twist and deform during fabrication of the part.

Further, according to traditional techniques, the enclosures are limited to forming parts with only rudimentary or simple shapes. To fabricate parts into final shapes that are more complex, a significant amount of material must be machined away from the parts, which increases the time and complexity associated with fabrication of the parts. Traditionally, a ratio of a total volume of the rudimentary shape to a total volume of the final machined shape is at least between about 30 and about 60. Because metal powders are relatively expensive, the loss of material associated with machining parts with rudimentary shapes into more complex shapes results in added manufacturing costs.

SUMMARY

The subject matter of the present application provides embodiments of methods for forming tooling, and associated methods and apparatuses for fabricating a part made from metal powder, that overcome the above-discussed shortcomings of prior art techniques. In other words, the subject matter of the present application has been developed in response to the present state of the art, and in particular, in response to shortcomings of conventional methods and apparatuses for forming tooling used to fabricate parts made from metal powder.

According to one embodiment, a first method of forming tooling for fabricating a part made from a metal powder includes forming a first sheet. The first sheet includes a first protrusion that defines a first cavity and a first flange that extends about an entire periphery of the first protrusion. The first method also includes forming a second sheet that includes a second flange. Additionally, the first method includes arranging the first sheet and the second sheet adjacently to each other to abut together the first flange of the first sheet and the second flange of the second sheet and to define an enclosure. The enclosure includes a void defined between the first cavity of the first sheet and the second sheet. The void has a shape of the part. The first method further includes welding together the first flange of the first sheet and the second flange of the second sheet along a portion of the first flange spaced away from the first protrusion.

In some implementations of the first method, the second sheet includes a second protrusion that defines a second cavity. The second flange extends about an entire periphery of the second protrusion. The void is defined between the first cavity of the first sheet and the second cavity of the second sheet. Welding together the first flange of the first sheet and the second flange of the second sheet includes welding along a portion of the second flange spaced away from the second protrusion.

According to certain implementations of the first method, welding together the first flange of the first sheet and the second flange of the second sheet includes forming a continuous weld about the entire peripheries of the first protrusion of the first sheet and the second protrusion of the second sheet. The continuous weld can be spaced the same distance away from the first protrusion of the first sheet and the second protrusion of the second sheet about the entire peripheries of the first protrusion and the second protrusion. The continuous weld can be spaced a distance away from the first protrusion and the second protrusion. The distance is at least 0.125 inches in some implementations.

In certain implementations of the first method, the first cavity has a first three-dimensional shape and the second cavity has a second three-dimensional shape. The first three-dimensional shape of the first cavity can be the same as the second three-dimensional shape of the second cavity. A shape of the first protrusion may complement the first three-dimensional shape of the first cavity, and a shape of the second protrusion may complement the second three-dimensional shape of the second cavity. At least one of the first three-dimensional shape of the first cavity and the second three-dimensional shape of the second cavity can have a complex geometry.

According to some implementations of the first method, a periphery of the first protrusion is the same shape and size as a periphery of the second protrusion. Arranging the first sheet and the second sheet adjacently to each other includes aligning the peripheries of the first protrusion and the second protrusion.

In one implementation of the first method, the first flange and the second flange are planar.

According to certain implementations, the first method further includes forming a through-channel in at least one of the first flange and the second flange. The through-channel is open to the void at a first end of the through-channel and open to an exterior of the enclosure at a second end of the through-channel opposite the first end of the through-channel.

In certain implementations of the first method, the first flange of the first sheet and the second flange of the second sheet are welded together via friction stir welding. In further implementations of the first method, at least one of the first sheet and the second sheet are formed via incremental sheet forming.

According to one embodiment, a second method of fabricating a part made from a metal powder includes forming a first sheet. The first sheet includes a first protrusion that defines a first cavity and a first flange that extends about an entire periphery of the first protrusion. The second method also includes forming a second sheet. The second sheet includes a second protrusion that defines a second cavity and a second flange that extends about an entire periphery of the second protrusion. The second method further includes arranging the first sheet and the second sheet adjacently to each other to abut together the first flange of the first sheet and the second flange of the second sheet and to define an enclosure. The enclosure includes a void defined between the first cavity of the first sheet and the second cavity of the second sheet. The void has a shape of the part. Additionally, the second method includes welding together the first flange of the first sheet and the second flange of the second sheet along a portion of the first flange spaced away from the first protrusion and a portion of the second flange spaced away from the second protrusion. The second method also includes filling the void of the enclosure with metal powder. Further, the second method includes heating the enclosure and metal powder in the void of the enclosure to a threshold temperature and pressurizing the enclosure and metal powder in the void of the enclosure to a threshold pressure to form a part in the void of the enclosure. The second method also includes removing the part from the enclosure.

In some implementations of the second method, the part in the void of the enclosure has an intermediate shape. The second method can further include shaping the part from the intermediate shape to a final shape. A ratio of a total volume of the intermediate shape and a total volume of the final shape can be less than about 6. The final shape of the part is a complex three-dimensional shape in certain implementations.

According to some implementations of the second method, the first cavity has a first three-dimensional shape and the second cavity has a second three-dimensional shape. The void can have a third-three-dimensional shape that includes a combination of the first three-dimensional shape and the second three-dimensional shape. The part in the void of the enclosure has the third three-dimensional shape.

In certain implementations, the second method also includes forming a through-channel in at least one of the first flange and the second flange. The through-channel is open to the void at a first end of the through-channel and open to an exterior of the enclosure at a second end of the through-channel opposite the first end of the through-channel. The second method further includes passing the metal powder through the through-channel to fill the void of the enclosure.

According to yet another embodiment, an apparatus for fabricating a part made from a metal powder includes a first sheet with a first protrusion that defines a first cavity and a first flange that extends about an entire periphery of the first protrusion. The apparatus also includes a second sheet with a second protrusion that defines a second cavity and a second flange that extends about an entire periphery of the second protrusion. The second flange of the second sheet abuts the first flange of the first sheet to define a void between the first cavity of the first sheet and the second cavity of the second sheet. The void has a shape of the part. The apparatus also includes a continuous weld formed in the first flange and the second flange. The continuous weld is spaced apart from the first protrusion of the first sheet and the second protrusion of the second sheet.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter, they are not therefore to be considered to be limiting of its scope. The subject matter will be described and explained with additional specificity and detail through the use of the drawings, in which.

DETAILED DESCRIPTION

Figure 1:
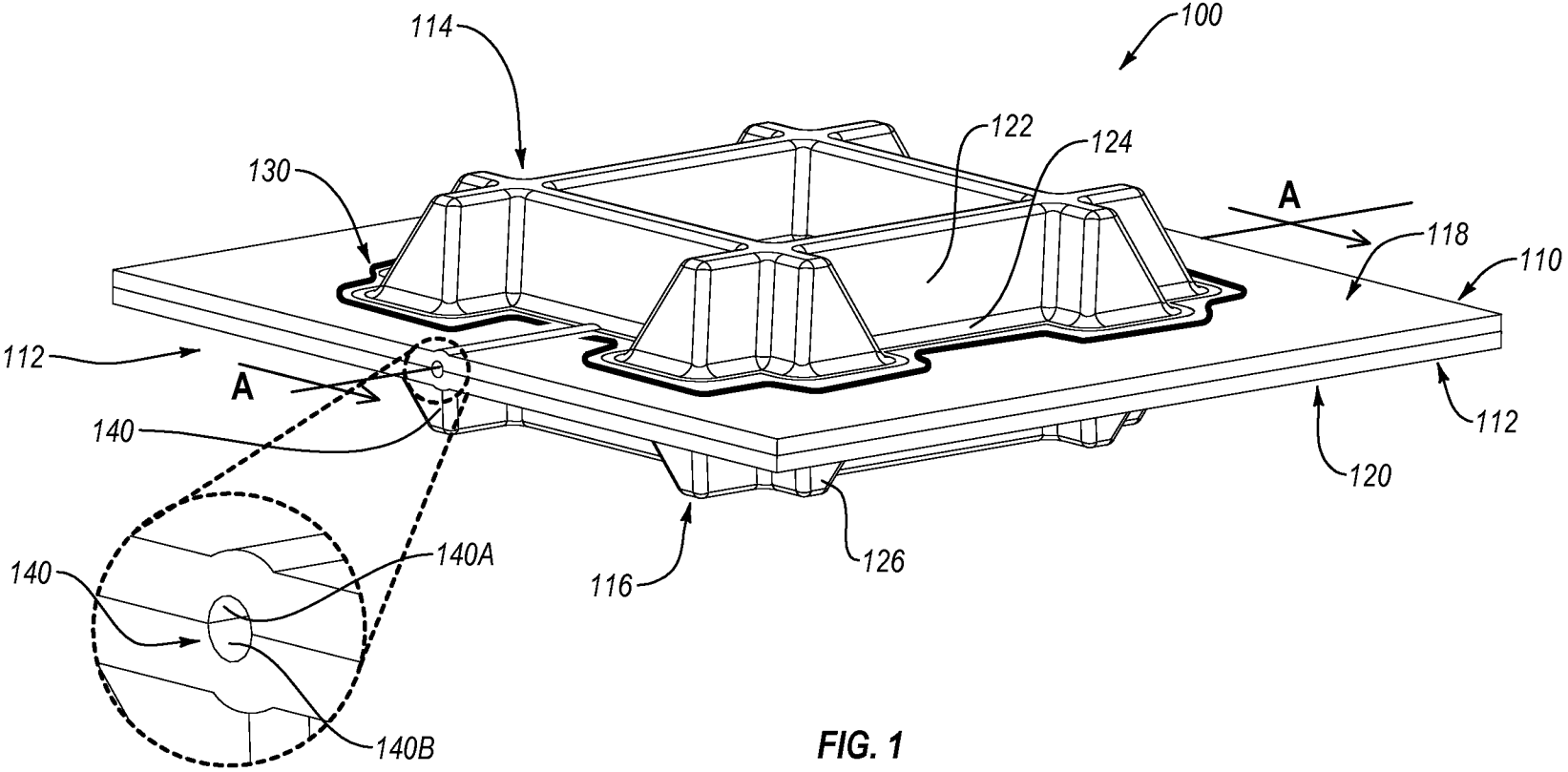
FIG. 1 is a perspective view of one embodiment of an enclosure for fabricating a part made from a metal powder.
Figure 2:
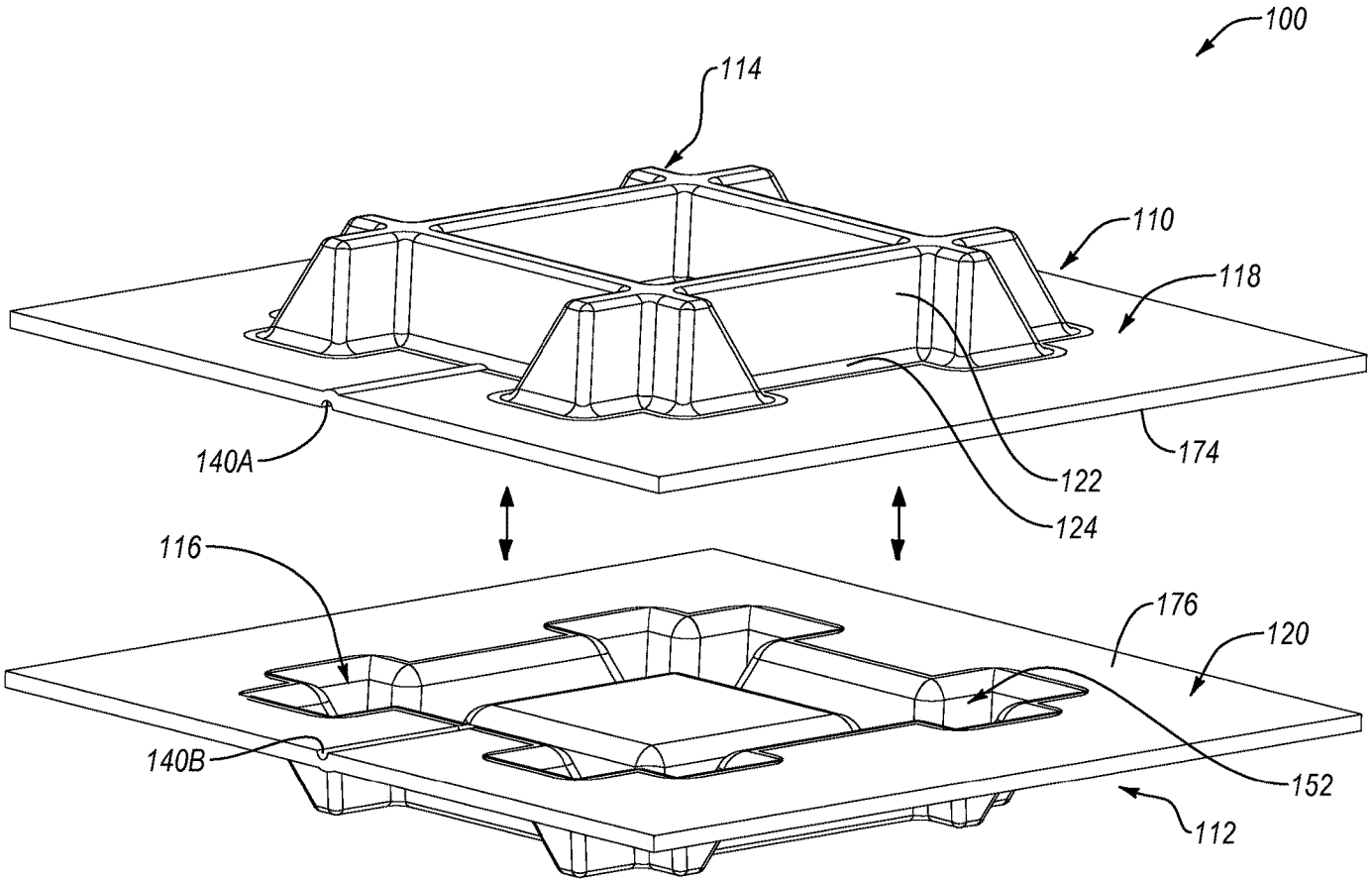
FIG. 2 is an exploded perspective view of the enclosure of FIG. 1 showing a first sheet of the enclosure separated from a second sheet of the enclosure according to one embodiment.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Referring to FIGS. 1-9, and according to one embodiment, an enclosure 100 for fabricating a part 190 made from metal powder 180 or powdered metal is shown. The enclosure 100 includes a first sheet 110 and a second sheet 112. The first sheet 110 is coupled to the second sheet 112 to form the enclosure 100. Moreover, the first sheet 110 includes a first protrusion 114 and the second sheet 112 includes a second protrusion 116. Extending about a periphery 125 of the first protrusion 114 is a first flange 118. Similarly, extending about a periphery 127 of the second protrusion 116 is a second flange 120. In the illustrated embodiment, the first flange 118 extends about the entire periphery 125 of the first protrusion 114, and the second flange 120 extends about the entire periphery 127 of the second protrusion 116. In this manner, on a given plane or curved surface, the first and second flanges 118, 120 effectively surround the first and second protrusions 114, 116. The first protrusion 114 includes one or more sidewalls 122 and a fillet 124, and the second protrusion 116 includes one or more sidewalls 126 and a fillet 128. The fillets 124, 128 provide a radiused transition region between the sidewalls 122, 126, and the first and second flanges 118, 120, respectively. Although the first and second protrusions 114, 116 include fillets 124, 128 between the sidewalls 122, 126 and the first and second flanges 118, 120, in some implementations, the first and second protrusions 114, 116 do not include fillets such that the sidewalls transition directly into the first and second flanges without a radiused or otherwise gradual transition region.

Figure 5:
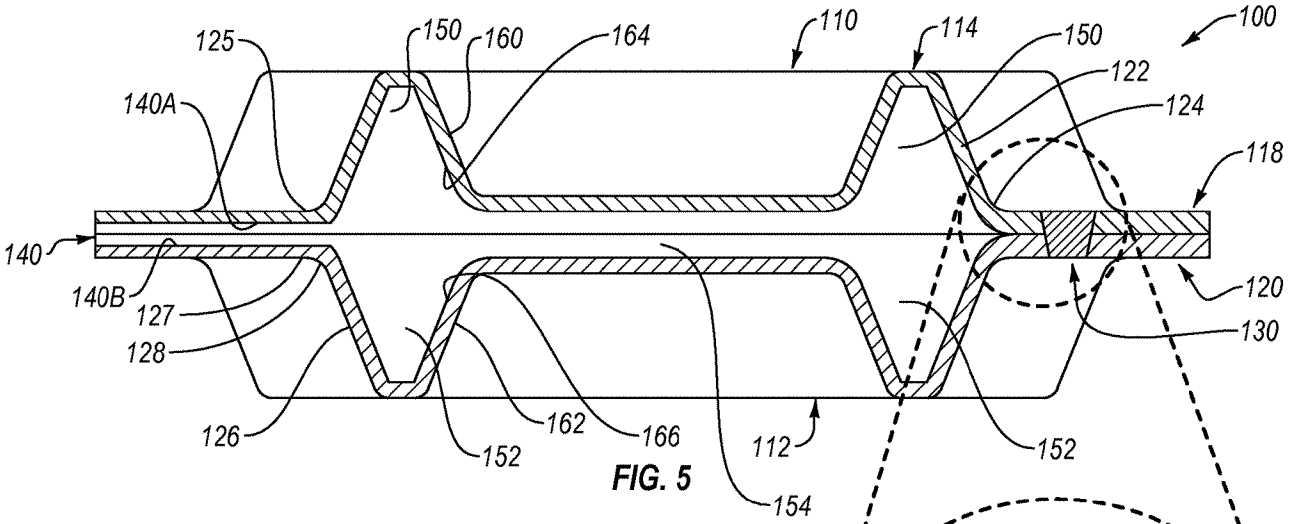
FIG. 5 is a cross-sectional side elevation view of the enclosure of FIG. 1 taken along the line A-A of FIG. 1.

As shown in FIG. 5, the first and second protrusions 114, 116 define first and second cavities 150, 152, respectively. More specifically, an interior surface 164 of the first protrusion 114 defines the first cavity 150, and an interior surface 166 of the second protrusion 116 defines the second cavity 152. Therefore, the shape and size of the interior surfaces 164, 166 of the first and second protrusions 114, 116 define the shape and size of the first and second cavities 150, 152, respectively. The interior surfaces 164, 166 can have any of various shapes and sizes to define first and second cavities 150, 152 with any of various complementary shapes and sizes. In the illustrated embodiment, the interior surfaces 164, 166 are shaped to define first and second cavities 150, 152 with three-dimensional shapes. As defined herein, a three-dimensional shape is a shape with complex geometries or a shape with at least one portion extending at an angle relative to another portion such that an interior angle is defined between the portions. The three-dimensional shapes of the first and second cavities 150, 152 in the illustrated embodiment are just one example of any of an infinite number of possible three-dimensional shapes that could be defined by the interior surfaces 164, 166 of the first and second protrusions 114, 116, respectively. In other words, the first and second protrusions 114, 116 can be configured differently than those shown to have interior surfaces 164, 166 that define three-dimensional shapes different than those shown without departing from the essence of the present disclosure. For example, the three-dimensional shapes of the first and second cavities 150, 152 can be more or less complex than the three-dimensional shapes shown in the illustrated embodiments.

The size and shape of the first and second cavities 150, 152 can be the same or different depending on a desired shape of the part being fabricated. In the illustrated embodiment, the size and shape of the first and second cavities 150, 152 are the same such that the shape of the part 190 is symmetrical across its midline. Alternatively, the size and shape of the first and second cavities 150, 152 can be differently sized, differently shaped, or both differently sized and shaped to produce a part that is asymmetrical.

Figure 6:
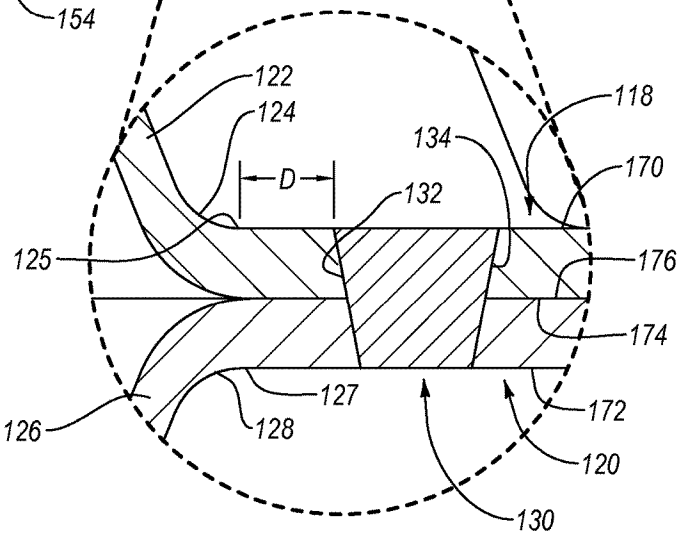
FIG. 6 is an enlarged view of a portion of the enclosure as shown in FIG. 4.
Figure 7:
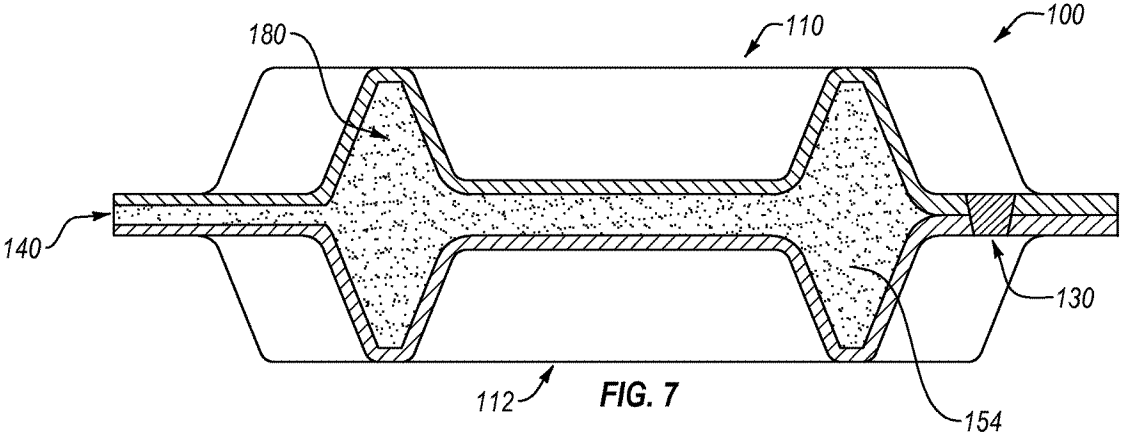
FIG. 7 is a cross-sectional side elevation view of the enclosure of FIG. 1 taken along the line A-A of FIG. 1 and shown filled with metal powder.

The first and second protrusions 114, 116 extend perpendicularly or obliquely away from the first and second flanges 118, 120, respectively. Referring to FIGS. 5 and 6, the first flange 118 includes an outer surface 170 and an opposing interface surface 174, and the second flange 120 includes an outer surface 172 and an opposing interface surface 176. The interface surfaces 174, 176 of the first and second flanges 118, 120, respectively, are shaped to complement and sit flush against each other. In this manner, a weld 130 can be properly formed in the first and second flanges 118, 120 across the interface surfaces 174, 176 to couple together the flanges, and thus coupled together the first and second sheets 110, 112. Additionally, in this manner, the weld 130 effectively seals the void 154 of the enclosure 100.

Although both the first and second protrusions 114, 116 are shown to define first and second cavities 150, 152 both with three-dimensional shapes, in some embodiments, one of the first and second cavities 150, 152 may have a three-dimensional shape, while the other of the first and second cavities does not. For example, in one embodiment, the first sheet 110 has a protrusion that defines a three-dimensional cavity, and the second sheet 112 does not have a protrusion. Although the second sheet 112 may be a flat sheet, because the cavity of the protrusion of the first sheet 110 is three-dimensional, the resulting part also will be three-dimensional.

In some embodiments, such as in the illustrated embodiment, the first and second flanges 118, 120 are planar. In other words, the interface surfaces 174, 176 of the first and second flanges 118, 120 are planar (e.g., flat). For example, as in the illustrated embodiment, the interface surface 174 of the first flange 118 can be co-planar about the entire periphery 125 of the first protrusion 114, and the interface surface 176 of the second flange 120 can be co-planar about the entire periphery 127 of the second protrusion 116, such that when coupled together the entirety of the first and second flanges are parallel to each other. However, in other embodiments, although planar, some portions of the first flange 118 are not co-planar with other portions of the first flange, and some portions of the second flange 120 are not co-planar with other portions of the second flange. For example, one side of the interface surfaces 174, 176 of the first and second flanges 118, 120 may be angled in a first direction and another side of the first and second flanges may be non-angled or angled in a different direction.

According to other embodiments, the first and second flanges 118, 120 are non-planar. In other words, the interface surfaces 174, 176 of the first and second flanges 118, 120 can be sharply or gradually contoured. For example, in certain implementations, the interface surfaces 174, 176 may be rounded, pointed, or the like. In some implementations, one of the interfaces surfaces 174, 176 is concave and the other of the interface surfaces is convex, such that the convex surface is nestably engaged with the concave surface.

Figure 3:
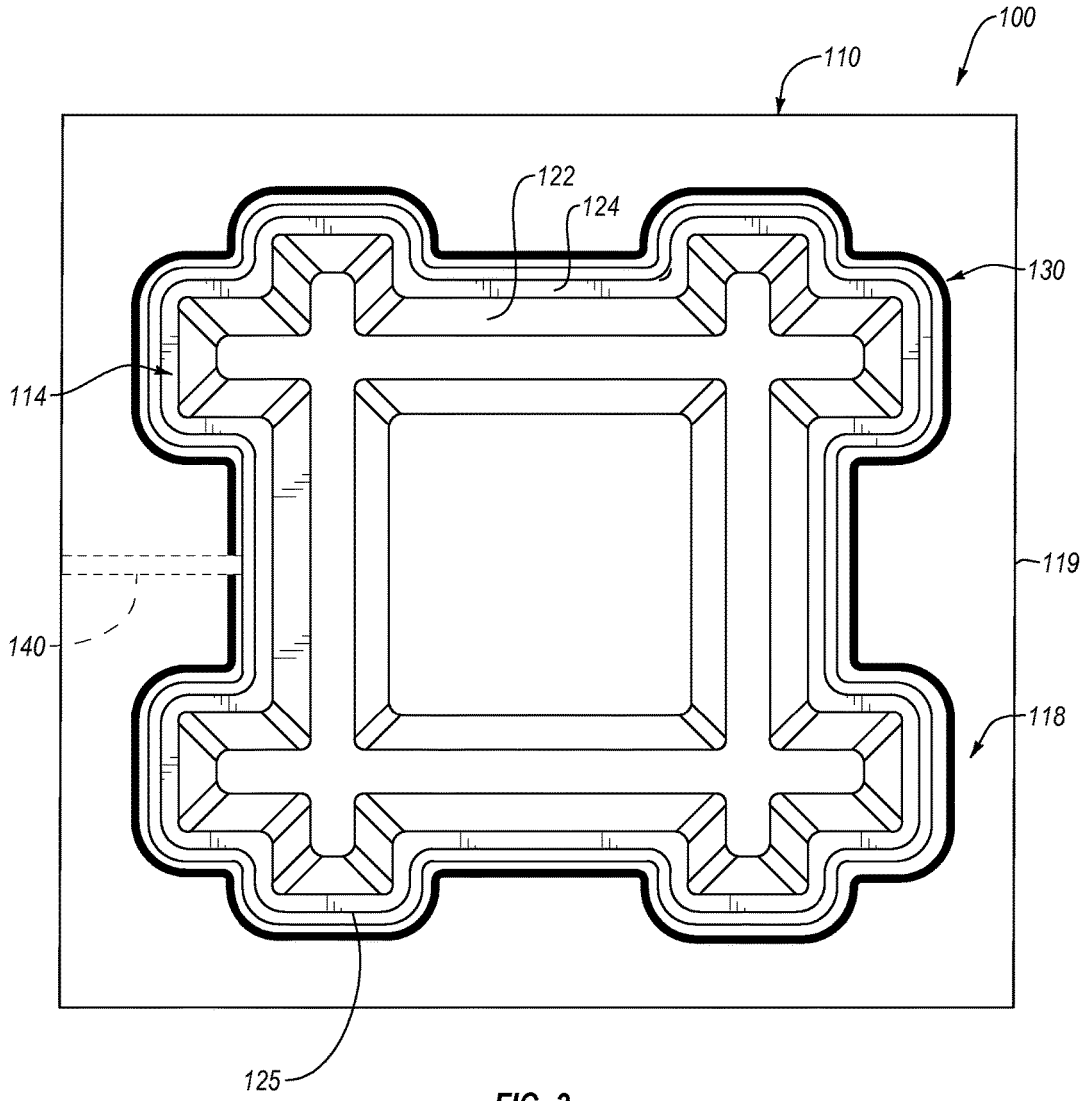
FIG. 3 is a top plan view of the enclosure of FIG. 1.
Figure 4:
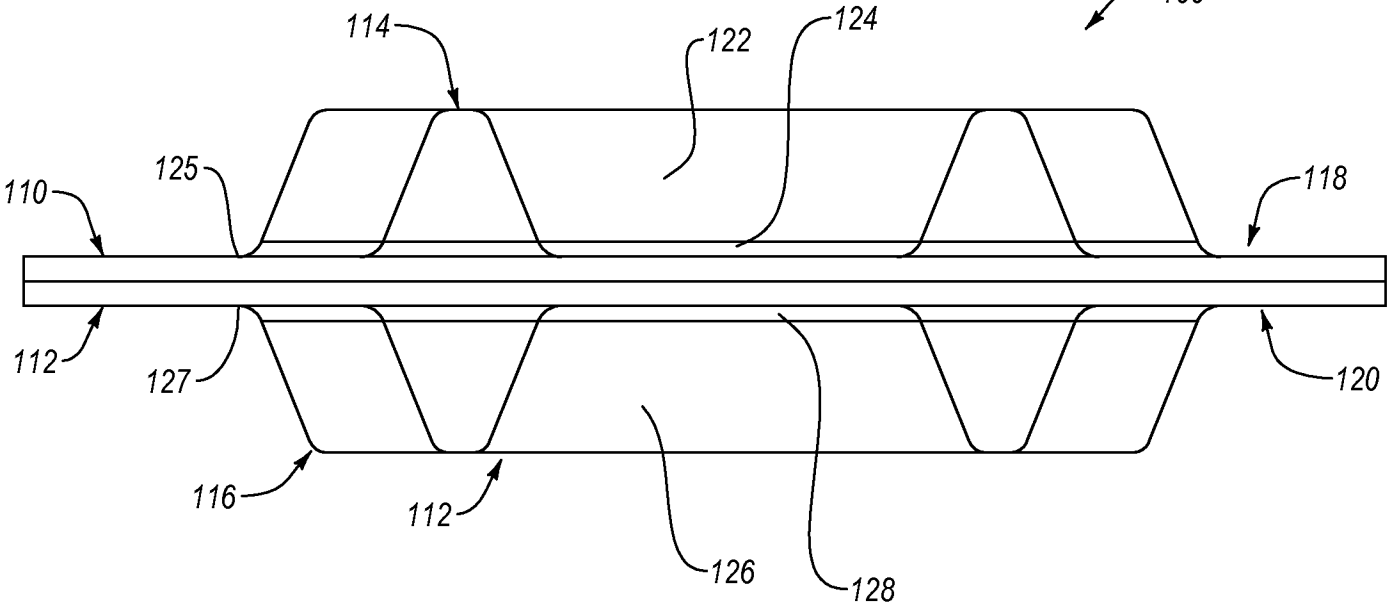
FIG. 4 is a side elevation view of the enclosure of FIG. 1.

Referring to FIG. 3, the first and second flanges 118, 120 each have an outer periphery 119. The outer periphery 119 of each of the first and second flanges 118, 120 can be any of various shapes and sizes. Moreover, the size and shape of the outer peripheries 119 of the first and second flanges 118, 120 can be the same or different. As shown, in some implementations, the outer peripheries 119 of the first and second flanges 118, 120 have the same shape and size for facilitating ease in forming and handling the enclosure 100. The shape of the outer peripheries 119 in the illustrated implementation is substantially square or rectangular. However, in other implementations, the shape of the outer peripheries 119 can be non-square or non-rectangular, such as, for example, circular, ovular, triangular, and the like. Alternatively, the shape of the outer peripheries 119 of the first and second flanges 118, 120 can be the same as the shape of the corresponding outer peripheries 25, 27 of the first and second protrusions 114, 116.

The first protrusion 114 and the first flange 118 of the first sheet 110 form a one-piece monolithic construction, and the second protrusion 116 and the second flange 120 of the second sheet 112 form a one-piece monolithic construction, in some embodiments. In the illustrated embodiment, each of the first and second sheets 110, 112 has a constant thickness across at least one of the respective protrusions and flanges of the first and second sheets. For example, in one implementation, the first protrusion 114 of the first sheet 110 has a constant thickness, and the second protrusion 116 of the second sheet 112 has a constant thickness. In such an implementation, an exterior surface 160 of the first protrusion 114 complements (e.g., has the same shape and size as) the interior surface 164 of the first protrusion. Likewise, in such an implementation, an exterior surface 162 of the second protrusion 116 complements the interior surface 166 of the second protrusion. In the same or an alternative example, the flange 118 of the first sheet 110 has a constant thickness and the flange 120 of the second sheet 112 has a constant thickness. In yet some embodiments, the thickness across at least one of the respective protrusions and flanges of the first and second sheets 110, 112 may vary. Whether constant or varying, the thickness of the first and second sheets 110, 112 (e.g., distance between interior and exterior surfaces) is much smaller than the width and length of the sheets such that the first and second sheets have a generally sheet-like configuration.

Figure 10:
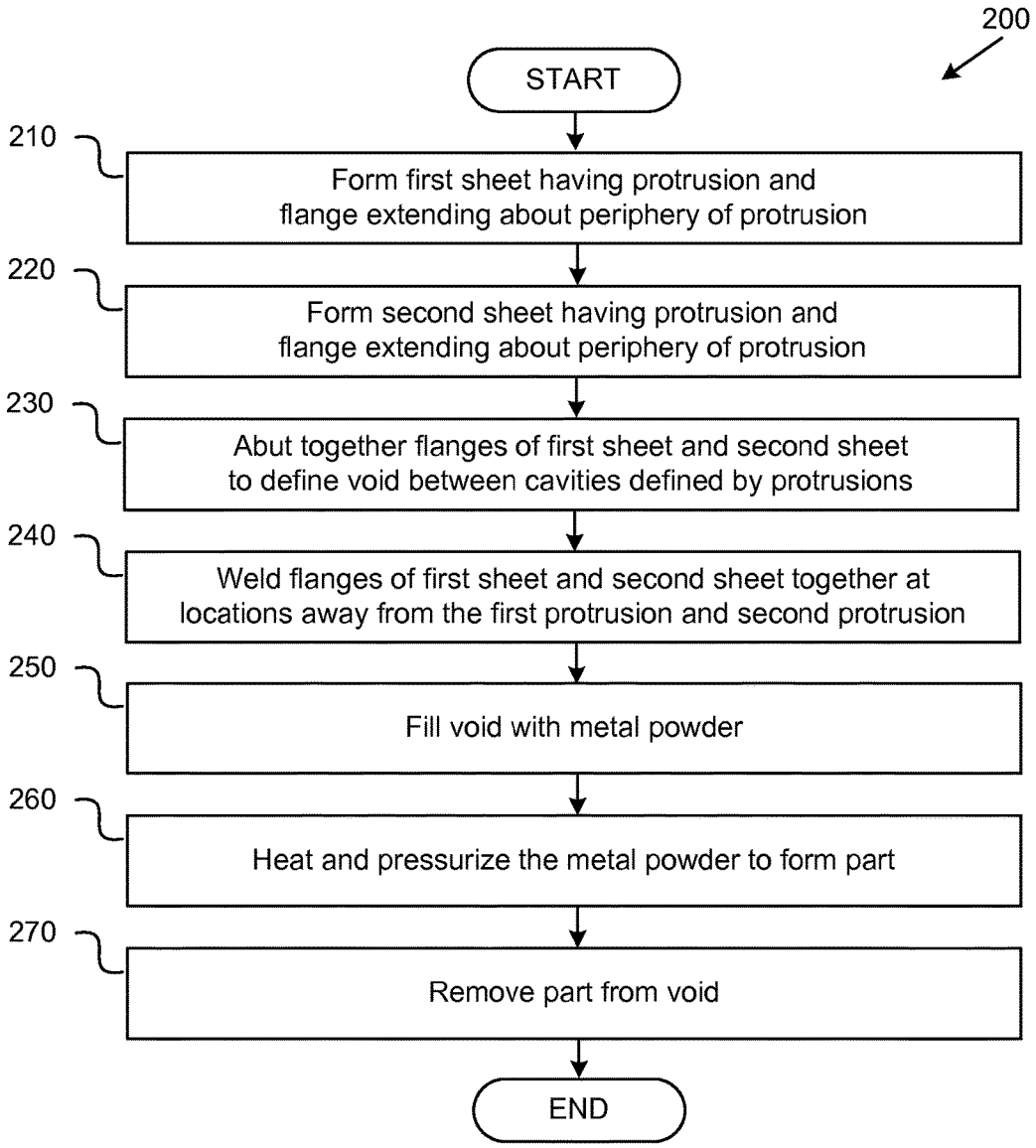
FIG. 10 is a schematic flow diagram of one embodiment of a method of forming tooling for fabricating a part made from a metal powder, and an associated method of fabricating the part.

Referring to FIG. 10, a method 200 of forming tooling for fabricating a part made from a metal powder includes forming a first sheet, such as the first sheet 110, that has a protrusion and a flange extending about a periphery of the protrusion at 210. Similarly, the method 200 includes forming a second sheet, such as the second sheet 112, that has a protrusion and a flange extending about a periphery of the protrusion at 220. The first and second sheets 110, 112 can be made from any of various materials and formed using any of various manufacturing techniques. According to one embodiment, the first and second sheets 110, 112 are made from a material such as, for example, metal, ceramic, polymer, fiber-reinforced composite, and combinations thereof. In some implementations, the first and second sheets 110, 112 are made from a metal or metal alloy, such as aluminum, steel, and the like. According to one embodiment, the first and second sheets 110, 112 are formed using a manufacturing technique such as, for example, casting, molding, machining, stamping, forging, bending, peening, and the like. In some implementations, the first and second sheets 110, 112 are made using an incremental sheet forming (ISF) technique. ISF techniques are useful for forming complex three-dimensional shapes, such as the shapes of the first and second protrusions 114, 116. Generally, ISF techniques include repeatedly imparting small incremental and localized deformations to a material using an impact tool until a desired shape of the material is achieved. Often, the impact tool is precisely controlled by a computerized numerically-controlled (CNC) machine to produce desired shapes with tight tolerances.

After the first and second sheets are formed at 210, 220, respectively, the method 200 includes abutting together the flanges of the first and second sheets to define a void between cavities defined by the protrusions of the first and second sheets at 230. In other words, the method 200 includes arranging the first and second sheets adjacently to each other such that the flanges of the sheets abut each other. More specifically, in the illustrated embodiment as shown in FIG. 5, the interface surfaces 174, 176 of the first and second flanges 118, 120, respectively, abut each other. As described above, the interface surfaces 174, 176 can be configured to sit flush against each other about substantially the entire peripheries 125, 127 of the respective protrusions 114, 116. The peripheries 125, 127 of the first and second protrusions 114, 116 can have the same shape and size. Moreover, abutting the first and second flanges 118, 120 at 230 can include arranging the first and second sheets 110, 112 adjacently to each other such that the peripheries 125, 127 of the first and second protrusions 114, 116 are aligned. Alignment of the peripheries 125, 127 can be defined as being aligned in a direction perpendicular to an interface plane or midplane between the first and second protrusions 114, 116. From the perspective shown in FIG. 5, the peripheries 125, 127 can be aligned in a direction extending from top-to-bottom of the page or a vertical direction. Alignment of the peripheries 125, 127 of the first and second protrusions 114, 116 may also include alignment of the peripheries of the first and second cavities 150, 152 defined by the first and second protrusions.

After the first and second sheets are arranged adjacently to each other and the first and second flanges abut each other, the method 200 includes welding together the first and second flanges at 240 to fixedly couple together the first and second sheets to form an enclosure. The weld or weldment formed in the first and second flanges at 240 of the method 200 is spaced away from the first and second protrusions of the first and second sheets, respectively. In certain implementations, the weld is spaced away from the first and second protrusions by being non-adjoining or non-coincident with the protrusions. In other words, some portion of the flange is positioned between the weld and the protrusions. Spacing the weld away from the protrusions prevents residual stresses from being formed in and deformation of the protrusions by the weld.

Referring to FIGS. 5 and 6, in the illustrated embodiment, the weld 130 is formed in the first and second flanges 118, 120 and spaced a predetermined distance D away from the peripheries 125, 127 of the first and second protrusions 114, 116. In some implementations, the predetermined distance D is the same about the entire peripheries 125, 127 of the first and second protrusions 114, 116. The distance D is defined between the outermost extents of the first and second peripheries 125, 127 and an innermost extent of the inner periphery 132 of the weld 130. The inner periphery 132 of the weld 130 opposes an outer periphery 134 of the weld. The inner and outer peripheries 132, 134 of the weld 130 are defined as the respective peripheries of the portions of the first and second flanges 118, 120 that are thermomechanically affected by the welding process. Accordingly, the inner and outer peripheries 132, 134 of the weld 130 can be defined as the interface or transition between the region of the first and second flanges 118, 120 thermomechanically affected by the welding process and the region of the flanges thermomechanically unaffected by the welding process. The distance D is greater than zero. In some implementations, the distance D is at least 0.125 inches. In yet certain implementations, the distance D is between 0.05 inches and about 0.5 inches. According to some implementations, the distance D calculated based on a diameter of the pin and shoulder portions of a wear-resistant rotating tool for friction stir welding (FSW) processes, an estimated width of the heat affected zone of the weld 130, and a preferred dimension for clearance between the tool and a tangency point of radii of fillets 124, 128, respectively.

The weld 130 can be formed using any of various fusion welding techniques configured to thermomechanically alter the materials of adjoining sheets to permanently mix together the materials and join together the sheets. For example, the weld 130 can be formed using friction stir welding (FSW), laser welding, arc welding, and the like. FSW techniques include the use of a wear-resistant rotating tool to join adjoining sheets together. The rotating tool includes a shoulder from which extends a profiled pin. In the illustrated embodiment, the shoulder frictionally engages or presses against the outer surface 170, 172 of one of the flanges 118, 120 of the first and second sheets 110, 112. With the shoulder against the outer surface of a flange, the profiled pin penetrates at least partially through both the first and second flanges 118, 120. Friction due to rotation of the tool generates heat in the material of the first and second flanges 118, 120. The heat generated by the rotating tool is sufficient to soften the material and thermomechanically alter the material without melting the material. The softened material of the first and second flanges 118, 120 is stirred together and allowed to cool (e.g., harden) to permanently join together the material and thus the first and second flanges.

A continuous weld, as opposed to a spot weld, is formed in a desired pattern using FSW techniques by translationally moving the rotating tool, while engaging and thermomechanically altering the flanges, along the outer surface of one of the flanges in the desired pattern. As mentioned above, the desired pattern complements the shape of the outer peripheries 125, 127 of the first and second protrusions 114, 116. Generally, the diametric extent or periphery of the shoulder of the tool defines the inner and outer peripheries 132, 134 of the weld 130. In other words, thermomechanical alternation of the material of the first and second flanges 118, 120 is contained within the footprint of the shoulder of the rotating tool. In this manner, controlling the position of the shoulder of the rotating tool relative to the outer peripheries 125, 127 of the first and second protrusions 114, 116 also controls the location of the weld 130 relative to the outer peripheries of the first and second protrusions. Therefore, the rotating tool is positioned such that the shoulder of the rotating tool is the predetermined distance D away from the outer peripheries 125, 127 of the protrusions, which results in the weld 130 being the desired distance D away from the outer peripheries.

After the flanges of the first and second sheets are welded together at 240 to form an enclosure defining a void, the method 200 includes filling the void with metal powder at 250. In the illustrated embodiment, the void 154 of the enclosure 100 is filled with metal powder 180 by passing the metal powder through a through-channel 140 formed in the enclosure 100. Accordingly, filling the void with metal powder at 250 may include forming a through-channel in at least one of the flanges of the first and second sheets of the enclosure. The through-channel 140 can be formed in at least one of the first and second flanges 118, 120 of the first and second sheets 110, 112, respectively. As shown, the through-channel 140 is defined by two opposing sub-channels 140A, 140B formed in the interface surfaces 174, 176 of the first and second flanges 118, 120, respectively. In other words, half of the through-channel 140 is formed in the first flange 118 and the other half of the through-channel is formed in the second flange. In alternative embodiments, the entirety of the through-channel 140 can be formed in one or the other of the first and second flanges 118, 120. Notwithstanding how the through-channel 140 is formed, the through-channel is configured to be open to the void on one end and open to an exterior of the enclosure 100 on another other end. Accordingly, the through-channel 140 extends through the flanges 118, 120 and into the void 154 In this manner, after the enclosure 100 is formed, access to the void 154, such as for passing metal powder 180 into the void, is available from outside the enclosure.

The metal powder 180 can be any of various metal powders known in the art. For example, in some implementations, the metal powder is one or more of an aluminum powder, an iron powder, and the like. The metal powder 180 may include additives, such as lubricant wax, carbon, copper, and nickel, that help to bind the metal powder together during a part forming process. Although a metal powder is the focus of the present disclosure, non-metal powders may be used.

After the void of the enclosure is filled with metal powder at 250, the method 200 may include evacuating air from the void in preparation for a part forming process. The air may be removed using a vacuum pump or other similar device. In one implementation, a vacuum pump evacuates air from within the void using the same through-channel used to supply metal powder into the void. However, according to other implementations, a secondary through-channel is used to evacuate air from the void.

When the enclosure is filled with metal powder and air is evacuated from the void, the through-channel(s) are sealed. The through-channel(s) can be sealed using any of various methods, such as welding shut the through-channel(s), collapsing the through-channel(s), and the like. In the illustrated implementation, the through-channel 140 is welded shut using the same welding technique used to join together the first and second flanges 118, 120. In other implementations, the through-channel can be welded shut using a different welding technique. Because in some implementations the through-channel 140 may not be welded shut using the same continuous weld 130 formed around the peripheries 125, 127 of the protrusions 114, 116, or may be collapsed shut, as defined herein a weld is a continuous weld in the flanges about an entire periphery of the protrusions if the weld in the flanges extends about the entire periphery of the protrusions but for the portion of the flanges occupied by the through-channel.

Figure 8:
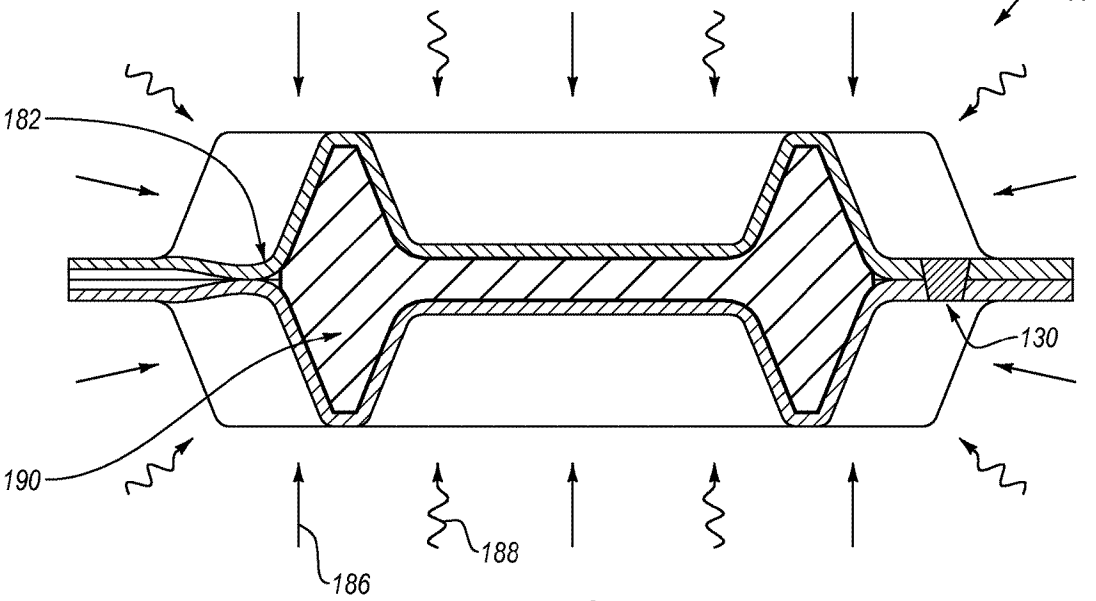
FIG. 8 is a cross-sectional side elevation view of the enclosure of FIG. 1 taken along the line A-A of FIG. 1 and shown with a part formed in the enclosure under heat and pressure.
Figure 9:
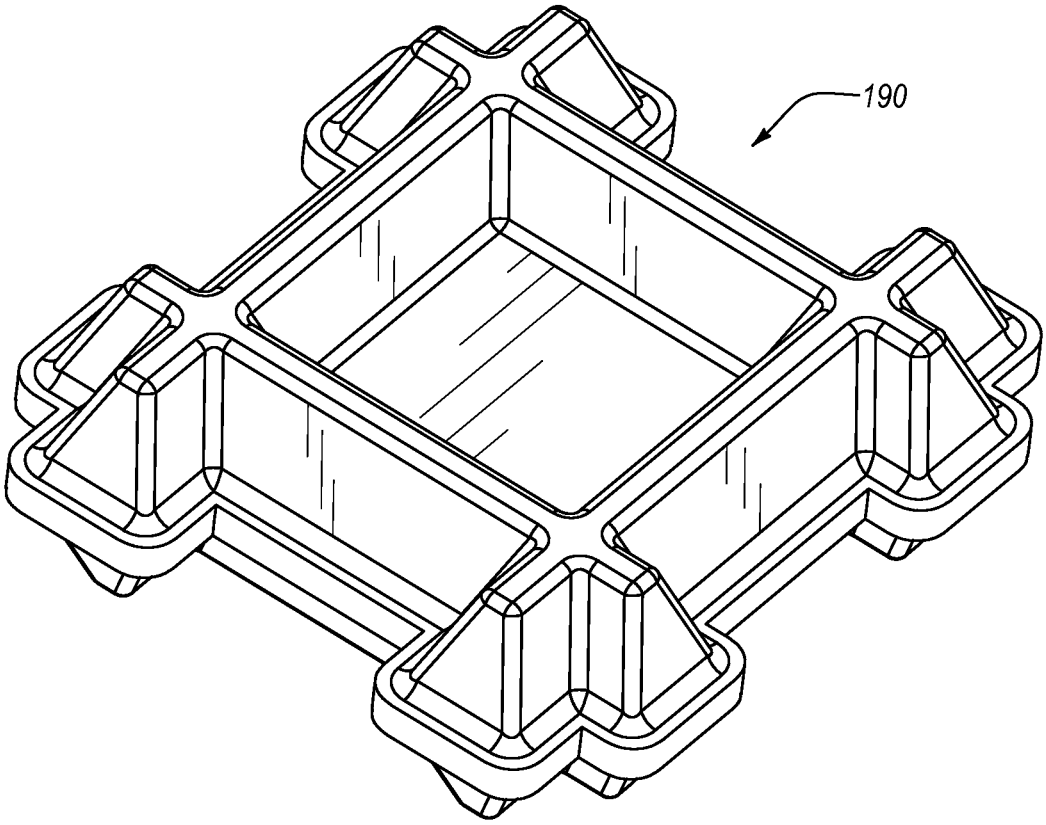
FIG. 9 is a perspective view of a part formed in and removed from the enclosure of FIG. 1.

After the void of the enclosure is filled with metal powder, air is evacuated from the void, and the through-channel(s), or other means used to fill the void and evacuate the air, is sealed, the method 200 includes heating and pressurizing the metal powder to form a part at 260. Referring to FIG. 8, pressure 186 and heat 188 applied to the enclosure 100 also pressurizes (e.g., compacts) and heats the metal powder 180. The pressure 186 and heat 188 are interdependently selected to achieve a desired density or compactness of the part, such as the part 190. In some implementations, the pressure 186 can be between about 2,000 psi and about 40,000 psi. The heat 188 can include temperatures between about 900° F. and about 2,250° F. In some implementations, the enclosure 100 and the metal powder 180 is pressurized and heated in a hot isostatic pressure (HIP) chamber as is commonly known in the art.

After the metal powder is heated and pressurized such that the formed part is compacted to a desired density, the method 200 includes removing the part from the void of the enclosure at 270. In some implementations, the part can be removed from the void of the enclosure by cutting through the enclosure. For example, a cutting tool may be employed to cut through one or both of the first and second sheets 110, 112 to form an opening through which the part 190 can be removed. Removing the part 190 can also include bending or peeling back the cut sheets to access the part 190.

The shape of the part in the enclosure, and the shape of the part upon being removed from the enclosure, can be considered to have an intermediate three-dimensional shape. In certain embodiments, the part is further shaped from the intermediate three-dimensional shape into a final three-dimensional shape. Further shaping of the part from the three-dimensional shape to the final three-dimensional shape can include removing material from the part. The final three-dimensional shape of the part can be defined as the shape of the part during use for its intended purpose. Because the enclosure 100 and method 200 of forming tooling and fabricating a part using the tooling facilitate the formation of complex three-dimensional parts, only a minimal amount of material is removed from the part with the intermediate three-dimensional shape to achieve the final three-dimensional shape. In some implementations, a ratio of a total volume of the intermediate shape to a total volume of the final shape is less than or equal to between about 3.0 and about 6.0.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A method of forming tooling for fabricating a part made from a metal powder, comprising:
   - providing a first sheet having a constant thickness;
   - forming a first protrusion in the first sheet, the first protrusion defining a first cavity and the first sheet comprising a first flange extending about an entire periphery of the first protrusion;
   - providing a second sheet having a thickness similar to that of the first sheet;
   - forming a second protrusion in the second sheet, the second protrusion defining a second cavity and the second sheet comprising a second flange extending about an entire periphery of the second protrusion;
   - arranging the first sheet and the second sheet adjacently to each other to abut together the first flange of the first sheet and the second flange of the second sheet and to define an enclosure comprising a void defined by the first cavity of the first sheet and the second cavity of the second sheet, the void having a shape of the part; and
   - welding together the first flange of the first sheet and the second flange of the second sheet along a portion of the first flange spaced away from the first protrusion.

2. The method of claim 1, wherein:
   - welding together the first flange of the first sheet and the second flange of the second sheet comprises welding along a portion of the second flange spaced away from the second protrusion.

3. The method of claim 2, wherein welding together the first flange of the first sheet and the second flange of the second sheet comprises forming a continuous weld about the entire peripheries of the first protrusion of the first sheet and the second protrusion of the second sheet.

4. The method of claim 3, wherein the continuous weld is spaced the same distance away from the first protrusion of the first sheet and the second protrusion of the second sheet about the entire peripheries of the first protrusion and the second protrusion.

5. The method of claim 3, wherein:

the continuous weld is spaced a distance away from the first protrusion and the second protrusion; and the distance is at least 0.125 inches.

6. The method of claim 2, wherein the first cavity has a first three-dimensional shape and the second cavity has a second three-dimensional shape.

7. The method of claim 6, wherein the first three-dimensional shape of the first cavity is the same as the second three-dimensional shape of the second cavity.

8. The method of claim 6, wherein:

a shape of the first protrusion complements the first three-dimensional shape of the first cavity; and a shape of the second protrusion complements the second three-dimensional shape of the second cavity.

9. The method of claim 6, wherein at least one of the first three-dimensional shape of the first cavity and the second three-dimensional shape of the second cavity comprises complex geometries.

10. The method of claim 2, wherein:

a periphery of the first protrusion is the same shape and size as a periphery of the second protrusion; and arranging the first sheet and the second sheet adjacently to each other comprises aligning the peripheries of the first protrusion and the second protrusion.

11. The method of claim 2, wherein the first flange and the second flange are planar.

12. The method of claim 1, further comprising forming a through-channel in at least one of the first flange and the second flange, the through-channel being open to the void at a first end of the through-channel and open to an exterior of the enclosure at a second end of the through-channel opposite the first end of the through-channel.

13. The method of claim 1, wherein the first flange of the first sheet and the second flange of the second sheet are welded together via friction stir welding.

14. The method of claim 1, wherein at least one of the first sheet and the second sheet are formed via incremental sheet forming.

15. A method of forming tooling for fabricating a part made from a metal powder, comprising:

providing a first sheet having a constant thickness;

forming a first protrusion in the first sheet, the first protrusion defining a first cavity and the first sheet comprising a first flange extending about an entire periphery of the first protrusion;

providing a second sheet having a constant thickness;

forming a second protrusion in the second sheet, the second protrusion defining a second cavity and the second sheet comprising a second flange extending about an entire periphery of the second protrusion;

arranging the first sheet and the second sheet adjacently to each other to abut together the first flange of the first sheet and the second flange of the second sheet and to define an enclosure comprising a void defined by the first cavity of the first sheet and the second cavity of the second sheet, the void having a shape of the part; and welding together the first flange of the first sheet and the second flange of the second sheet along a portion of the first flange spaced away from the first protrusion.

* * * * *